United States Patent [19]

Lempio

[11] Patent Number: 4,820,411

[45] Date of Patent: Apr. 11, 1989

[54] SWIMMING POOL SKIMMER

[76] Inventor: Paul S. Lempio, 11 Fay Dr., Kentfield, Calif. 94904

[21] Appl. No.: 773,450

[22] Filed: Sep. 6, 1985

[51] Int. Cl.[4] ..... E04H 3/16

[52] U.S. Cl. ..... 210/169; 210/242.1; 210/416.1; 134/167 R

[58] Field of Search ..... 210/169, 242.1, 242.3, 210/416.1; 34/167 R

[56] References Cited

U.S. PATENT DOCUMENTS 3,767,055 10/1973 Flatland ..... 210/169

4,053,412 10/1977 Stix ..... 210/169

4,089,074 5/1978 Sermons ..... 210/169

4,105,557 8/1978 Weatherholt ..... 210/242.1

*Primary Examiner*—Curtis R. Davis

*Assistant Examiner*—Sharon T. Cohen

*Attorney, Agent, or Firm*—Paul S. Lempio

[57] ABSTRACT

A swimming pool skimmer includes a float having skimming foil attached thereto. The skimming foil projects above the surface of the water to receive leaves and other debris thereover for deposit and retention in a receptacle. The receptacle may comprise a removable screen mounted below the float.

14 Claims, 1 Drawing Sheet

SWIMMING POOL SKIMMER

TECHNICAL FIELD

This invention relates generally to cleaning apparatus for a swimming pool and more particularly to a swimming pool skimmer adapted to float on water to collect debris.

BACKGROUND ART

Numerous types of apparatus have been proposed for skimming a swimming pool to remove leaves and other floating debris therefrom. Many such apparatus are water-powered and require hoses and connections therefor. Skimmers of this type are relatively complex and expensive and do not always provide the desired debris-carrying capacity. Further, the debris cannot be removed from the skimmer expeditiously and easily.

DISCLOSURE OF INVENTION

This invention overcomes the above briefly described prior art problems by providing an economical and efficient swimming pool skimmer.

The swimming pool skimmer comprises float means for floating on water, skimming means attached to the float means and projecting above the surface of the water for receiving debris thereover, and receptacle means for receiving and retaining the debris therein.

In one aspect of this invention, the skimming means is fixedly positioned relative to the float means and defines a fixed and curved upper skimming surface, having leading and trailing end portions and a curved intermediate portion. The skimming surface projects above the surface of the water and the water line of the pool skimmer for receiving debris floating on the water thereover and for preventing retrograde movement of the debris. The skimming surface defines a curved foil and the leading and trailing end portions of the skimming surface are disposed beneath the surface of the water and vertically below the water line of the skimmer.

In another aspect of this invention, means are provided for mounting the skimming means on the float means for permitting the skimming means to be selectively tilted relative to the float means to vary the extent of projection of the skimming means relative to the surface of the water.

In still another aspect of this invention, means are provided for vertically adjusting the position of the skimming means relative to the float means and the extent of projection of an upper surface of the skimming means above the surface of the water.

BRIEF DESCRIPTION OF THE DRAWING

Other advantages and objects of this invention will become apparent from the following description and accompanying drawings wherein.

BEST MODE OF CARRYING OUT THE INVENTION

Figure 1:
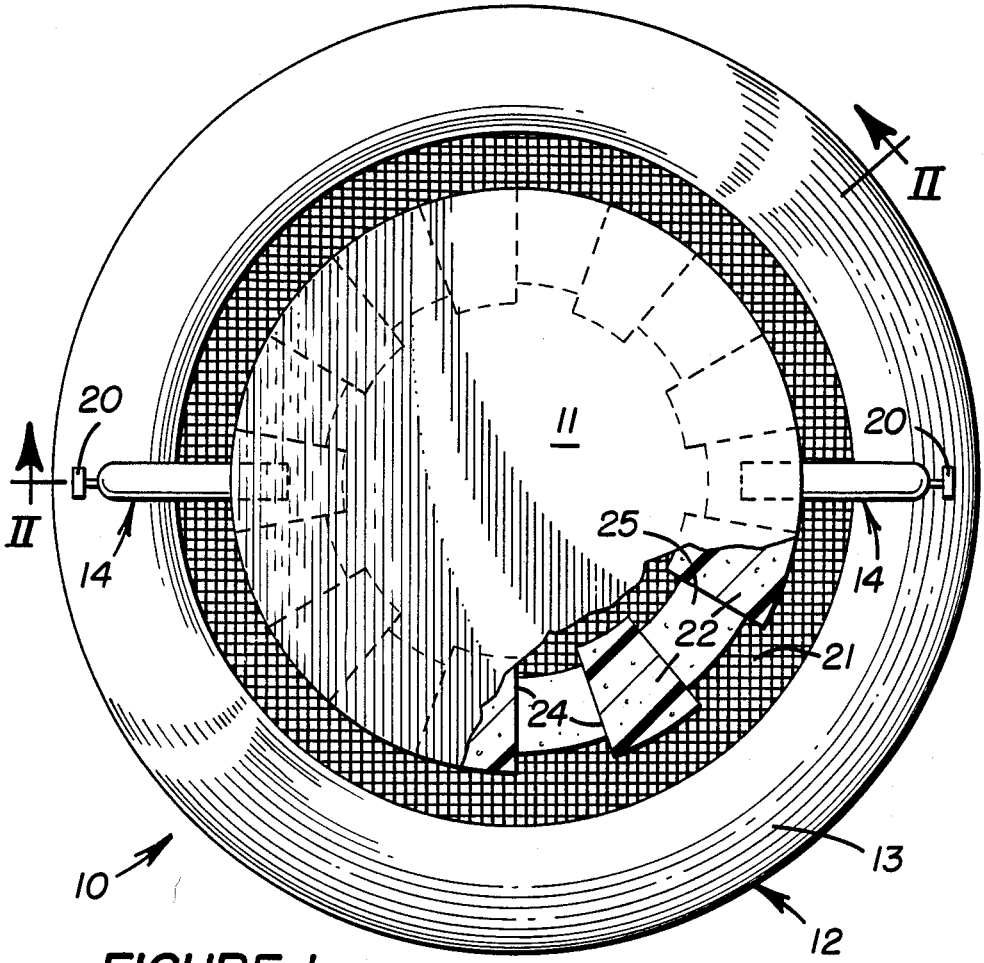
FIG. 1 is a partially sectioned, top plan view of a swimming pool skimmer embodying this invention.
Figure 2:
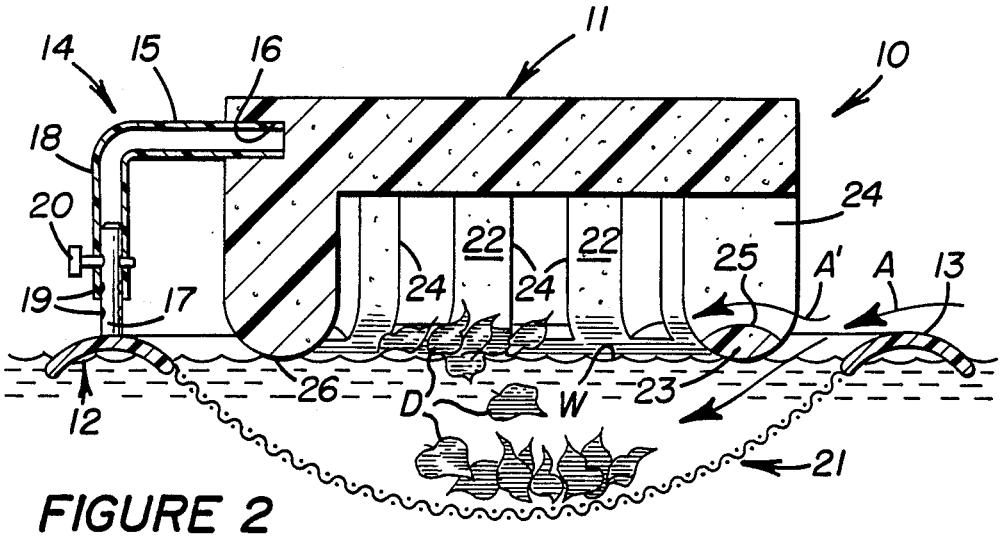
FIG. 2 is a sectional view through the skimmer, taken in the direction of arrows II—II in FIG. 1.

FIGS. 1 and 2 illustrate a swimming pool skimmer 10 adapted to float on the surface of water W in a swimming pool for removing leaves and other surface debris therefrom. The skimmer comprises a centrally disposed float 11 that may be formed from any suitable bouyant material having a specific gravity of less than 1.0 to maintain skimmer 10 in its floating position, illustrated in FIG. 2. For example, the material may constitute a closed-cell foamed plastic such as polypropylene, polystyrene (e.g., Styrofoam), or urethane.

An annular skimming foil 12 is attached to float 11 to provide a curved upper skimming surface 13, when viewed in cross section in FIG. 2, projecting above the surface of water W for receiving leaves and other floating debris D thereover. The skimming surface thus defines a curved foil with the leading and trailing ends of the skimming surface being disposed beneath the surface of the water and vertically below the water line of the skimmer (FIG. 2). Foil 12 not only functions to aid in the smooth travel of the debris thereover, but also provides a low-drag element that cuts through the water in a streamlined manner. In addition, the foil functions to stabilize the skimmer on the water.

Skimming foil 12 may be mounted in any suitable manner on float 11, such as by the illustrated pair of diametrically opposed mounting tubes 14. As shown in FIG. 2, each mounting tube 14 may comprise a standard thin-walled PVC (polyvinylchloride) tube having its horizontally disposed upper end 15 inserted into a bore 16, formed in a sidewall of the float. If so desired, the tube could be glued, pinned, or otherwise fixedly secured to the float.

In certain skimmer applications it may prove desirable to merely press-fit diametrically opposed and aligned ends 15 of the tubes into the float. Skimming foil 13 could thus be tilted about the aligned axes of such ends to vary the inclination of diametrically opposed portions of surfaces 13 relative to each other and to the level of water W.

Further, it may prove desirable to provide means for adjusting foil 13 vertically, relative to float 11 and the water level. Such adjustment means may comprise an upstanding rod 17, suitably secured on an upper side of foil 12 and reciprocally mounted in a lower end 18 of a respective mounting tube 14 (FIG. 2). The adjustment means further includes a plurality of adjustment holes 19 formed transversely through rod 17 and spaced longitudinally thereon and a locking pin 20. The locking pin can be inserted through aligned holes formed through lower end 18 of tube 14 and a selected positioning hole 19 to lock foil 12 in its desired vertical position relative to the float.

Swimming pool skimmer 10 further comprises a receptacle, shown in the form of a fine mesh plastic or copper wire screen 21 suitably secured entirely about the annular inner periphery of foil 12. Screen 21 may have a mesh number normally selected from the range of from 3 to 10, depending on the type and particle size of debris that is sought to be collected in any particular locality. As further illustrated in FIG. 2, the screen defines a concavity therein, disposed beneath and facing the float. The concavity is preferably spherical or hyperboloidal in configuration, when viewed in cross-section.

Float 11 is preferably circular and may be formed as a solid block of material or may be otherwise configured to meet specific pool skimming applications. For example, the illustrated skimmer embodiment shows the float as comprising a plurality of circumferentially spaced and upstanding partitions 22 and a circumferentially extending web 23 integrally formed between each pair of adjacent partitions. An opening 24 is thus defined between each pair of circumferentially adjacent partitions to permit leaves and other debris D to flow therethrough and into a chamber defined in the float which cooperates with screen 21 to form a receptacle for retaining the debris. Curved foil surfaces 25 and 26 are formed on the upper and lower sides of each web 23 to aid in the smooth ingress of leaves and other debris into the skimmer and to also reduce drag when the skimmer propels over and through the water.

When placed in operation in a pool, wind currents, as well as water currents induced by a standard pool filtering system, will induce skimmer 10 to move randomly over the surface of the pool. Debris will enter the skimmer for collection purposes, in the direction of arrow A in FIG. 2, through an annular opening defined between float 11 and foil 13. Additional debris will enter the confines of the skimmer, in the direction of arrow A' and through openings 24. Applicant has built and tested a prototype of the skimmer which generally included a float, a screen and a foil corresponding to foil 12 which functioned efficiently to collect and retain leaves and other debris.

It should be particularly noted that once the debris is trapped within the skimmer that the projection of foil surface 13 above the level of water W will prevent the egress of the debris back into the pool. Likewise, the disposition of curved foil surfaces 25 and 26 on the float proper, will further aid in preventing debris from escaping. In effect, a double-trap system is thus provided on the skimmer. Surfaces 13 and 25 are preferably at least generally positioned in horizontal alignment relative to each other. It should be further noted that when leaves and other debris become water-logged, that such debris will tend to sink into the water and be collected by the screen. When it is desired to remove the debris from the skimmer, the skimmer can be picked up from the pool, pins 20 released from mounting tubes 14, and the debris discarded. The pins can then be replaced and the skimmer redeposited in the pool.

It should be understood that various modifications can be made to skimmer 10 without departing from the spirit of this invention. For example, it may prove desirable to only open one or two sides of the skimmer for collection purposes, rather than provide for reception of the debris entirely around the skimmer. The skimmer can be configured as a rectangle, triangle, or any other desired shape. For example, the skimmer could be configured as a sailboat, a tugboat, a duck, a whale, a mermaid or the like.

I claim:

1. A swimming pool skimmer having a water line comprising, in combination, float means having a specific gravity of less than 1.0 for floating on water, skimming means fixedly positioned relative to said float means and defining a fixed and curved upper skimming surface, having leading and trailing end portions and a curved intermediate portion, projecting above the surface of said water and the water line of said pool skimmer for receiving debris floating on said water thereover and for preventing retrograde movement of said debris, said skimming surface defining a curved foil and wherein the leading and trailing end portions of said skimming surface are disposed beneath the surface of said water and vertically below said water line, receptacle means for receiving and retaining said debris therein, said skimming means defining means for preventing said debris from floating out of said receptacle means, and fixed and continuously fully open opening means defined in said skimmer for conducting said debris from said skimming means to said receptacle means.

2. The swimming pool skimmer of claim 1 wherein said float means is composed of an expanded foamed plastic material.

3. The swimming pool skimmer of claim 2 wherein said foamed plastic material comprises polystyrene, urethane or polypropylene.

4. The swimming pool skimmer of claim 1 wherein said receptacle means comprises a screen secured on said skimming means and positioned below said float means.

5. The swimming pool skimmer of claim 4 wherein said screen has a concavity formed therein facing said float means, when said skimmer is viewed in cross-section.

6. The swimming pool skimmer of claim 1 wherein said foil is annular and is spaced radially outwardly from said float means to define an annular opening of said opening means between said float means and said foil, circumferentially around said skimmer, for permitting the ingress of said debris within the confines of said skimmer.

7. The swimming pool skimmer of claim 6 wherein said receptacle means comprises a screen secured entirely about an annular inner periphery of said foil.

8. The swimming pool skimmer of claim 7 wherein said float means is annular and comprises a plurality of upstanding and circumferentially spaced partitions and a horizontally disposed web secured between each pair of circumferentially adjacent partitions.

9. The swimming pool skimmer of claim 8 wherein an upper surface of said web has a curved foil surface defined thereon at least generally positioned in horizontal alignment relative to an upper skimming surface of said first mentioned foil.

10. The swimming pool skimmer of claim 1 further comprising means mounting said skimming means on said float means for permitting said skimming means to be selectively tilted relative to said float means to vary the extent of projection of said skimming means relative to the surface of said water.

11. The swimming pool skimmer of claim 1 further comprising means for vertically adjusting the position of said skimming means relative to said float means and the extent of projection of an upper surface of said skimming means above the surface of said water.

12. The swimming pool skimmer of claim 1 wherein said skimming means is formed on said float means.

13. A swimming pool skimmer having a water line comprising, in combination, float means having a specific gravity of less than 1.0 for floating on water, skimming means fixedly positioned relative to said float means and defining a fixed and curved upper skimming surface, having leading and trailing end portions and a curved intermediate portion, projecting above the surface of said water and the water line of said pool skimmer for receiving debris floating on said water thereover and for preventing retrograde movement of said debris, receptacle means for receiving and retaining said debris therein, said skimming means defining means for preventing said debris from floating out of said receptacle means, fixed and continuously fully open opening means defined in said skimmer for conducting said debris from said skimming means to said receptacle means, and means mounting said skimming means on said float means for permitting said skimming means to be selectively tilted relative to said float means to vary the extent of projection of said skimming means relative to the surface of said water.

14. A swimming pool skimmer having a water line comprising, in combination, float means having a specific gravity of less than 1.0 for floating on water, skimming means positioned relative to said float means and defining a fixed and curved upper skimming surface, having leading and trailing end portions and a curved intermediate portion, projecting above the surface of said water and the water line of said pool skimmer for receiving debris floating on said water thereover and for preventing retrograde movement of said debris, receptacle means for receiving and retaining said debris therein, said skimming means defining means for preventing said debris from floating out of said receptacle means, fixed and continously fully open opening means defined in said skimmer for conducting said debris from said skimming means to said receptacle means, and means for vertically adjusting the position of said skimming means relative to said float means and the extent of projection of an upper surface of said skimming means above the surface of said water.

* * * * *